US005992838A

United States Patent [19]

Saitoh

[11] Patent Number: 5,992,838

[45] **Date of Patent: *Nov. 30, 1999**

[54] SHEET PROCESSING APPARATUS AND IMAGE FORMING APPARATUS

[75] Inventor: Naho Saitoh, Inagi, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/720,238

[22] Filed: Sep. 26, 1996

[30] Foreign Application Priority Data

Sep. 27, 1995 [JP] Japan ..... 7-249183

[51] Int. Cl.[6] ..... B65H 39/02

[52] U.S. Cl. ..... 270/58.09; 270/58.14; 270/58.19; 270/58.28

[58] Field of Search ..... 270/58.02, 58.28, 270/58.19, 58.23, 28.08, 58.09, 58.14, 58.16

[56] References Cited

U.S. PATENT DOCUMENTS

| | | | |
|---|---|---|---|
| 5,374,043 | 12/1994 | Mandel et al. | 270/58.14 |
| 5,434,661 | 7/1995 | Takahashi et al. | 270/58.08 |
| 5,524,873 | 6/1996 | Hosoi et al. | 270/58.08 |
| 5,531,430 | 7/1996 | Tokonoh | 270/58.19 |
| 5,551,680 | 9/1996 | Ohmichi et al. | 270/58.28 |

FOREIGN PATENT DOCUMENTS

| | | |
|---|---|---|
| 63-146094 | 6/1988 | Japan . |
| 63-299922 | 12/1988 | Japan . |

*Primary Examiner*—Noah P. Kamer

*Attorney, Agent, or Firm*—Fitzpatrick, Cella, Harper & Scinto

[57] ABSTRACT

A sheet processing apparatus includes a plurality of sheet discharging means for discharging sheets; a plurality of intermediate trays for temporarily stacking the sheets discharged by the discharging means; processing means for processing the sheets; a tray for receiving and accommodating the sheet from the intermediate trays; control means for facing one of the intermediate trays to one of the discharging means to stack the sheets on the intermediate tray and moving the intermediate tray to permit the sheets to be processed by the processing means; then facing, during processing for the sheets on the one of the intermediate trays, another one of the intermediate trays to another one of the discharging means to stack the sheets on the another intermediate tray: then returning, after discharging the sheets from the one of the intermediate trays after processing the sheets thereon, the one of the intermediate trays to the one of the discharging means; then moving the intermediate try to permit the sheets to be processed by the processing means; and discharging the processed sheets to the tray.

21 Claims, 16 Drawing Sheets

SHEET PROCESSING APPARATUS AND IMAGE FORMING APPARATUS

FIELD OF THE INVENTION AND RELATED ART

The present invention relates to a sheet processing apparatus for processing sheets discharged from an image forming apparatus and stacking them on a trays.

Conventionally, the sheet processing apparatus for processing sheets discharged from an image forming apparatus and stacking them on trays (finisher) having one fixed tray and one movable tray, as disclosed in Japanese Laid-open Patent Application No. Sho 63-146094 and Japanese Laid-open Patent Application No. Sho 63-299922.

In such an apparatus, when the sheets are stapled at two positions, the next sheet discharge has to be interrupted until the stapler returns to the home position, and therefore, the efficiency is not good.

SUMMARY OF THE INVENTION

Accordingly, it is a principal object of the present invention to provide a sheet processing apparatus in which the waiting time can be shortened.

According to an aspect of the present invention, there is provided a sheet processing apparatus, comprising: a plurality of sheet discharging means for discharging sheets; a plurality of intermediate trays for temporarily stacking the sheets discharged by said discharging means; processing means for processing the sheets; a tray for receiving and accommodating the sheet from the intermediate trays; control means for facing one of said intermediate trays to one of said discharging means to stack the sheets on said intermediate tray and moving the intermediate tray to permit the sheets to be processed by said processing means; then facing, during processing for the sheets on said one of the intermediate trays, another one of said intermediate trays to another one of sad discharging means to stack the sheets on said another intermediate tray; then returning, after discharging the sheets from said one of the intermediate trays after processing the sheets thereon, said one of the intermediate trays to said one of the discharging means; then moving the intermediate try to permit the sheets to be processed by said processing means; and discharging the processed sheets to said tray.

According to another aspect of the present invention, there is provided a sheet processing apparatus comprising a plurality of intermediate trays for temporarily stacking the sheets discharged by said discharging means; processing means for processing the sheets; a tray for receiving and accommodating the sheet from the intermediate trays; control means for feeding the sheets from one of said intermediate trays after the sheets thereon are processed by said process means; means for moving said intermediate trays between a home position for receiving the sheets from the image forming apparatus and a position for the processing by said processing means to permit the sheet to be stacked, while the sheets on said one of said intermediate trays are processed or fed to said accommodating tray, on another intermediate tray.

According to a further aspect of the present invention, there is provided a sheet processing apparatus comprising a plurality of intermediate trays for temporarily stacking the sheets discharged by said discharging means; processing means for processing the sheets; a tray for receiving and accommodating the sheet from the intermediate trays; control means for feeding the sheets from one of said intermediate trays after the sheets thereon are processed by said process means; wherein when the sheets have a relatively small size, the intermediate tray receives the sheets at a position other than the processing means, and feeds the sheets, after a predetermined number of sheets are received thereon, to said processing means, which process the sheets, which are in turn discharged to said accommodating tray; wherein next sheets are received by another one of said intermediate trays; wherein when the sheets have a relatively large size, said intermediate tray moves to said processing means to receive the sheets by said intermediate tray and said accommodating trays so that the sheets bridge therebetween, and after a predetermined number of sheets are received, the sheets are processed by said processing means, and are discharged to said accommodating tray.

According to a further aspect of the present invention, there is provided a sheet processing apparatus comprising a plurality of intermediate trays for temporarily stacking the sheets discharged by said discharging means; processing means for processing the sheets; a tray for receiving and accommodating the sheet from the intermediate trays; control means for feeding the sheets from one of said intermediate trays after the sheets thereon are processed by said process means; wherein when the sheets have a relatively small size, the intermediate tray receives the sheets at a position other than the processing means, and feeds the sheets, after a predetermined number of sheets are received thereon, to said processing means, which process the sheets, which are in turn discharged to said accommodating tray; wherein next sheets are received by another one of said intermediate trays; wherein when the sheets have a relatively large size and are not to be processed by said processing means, said intermediate tray moves to said processing means to receive the sheets by said intermediate tray and said accommodating trays so that the sheets bridge therebetween, and the sheets are discharged to said accommodating tray without being processed by said processing means.

According to a further aspect of the present invention, there is provided an image forming apparatus comprising image forming means and a sheet post processing apparatus as defined above.

According to the present invention, the efficiency is improved, and the productivity is improved. Additionally, the size of the sheet can be reduced.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Embodiment 1

Figure 1:
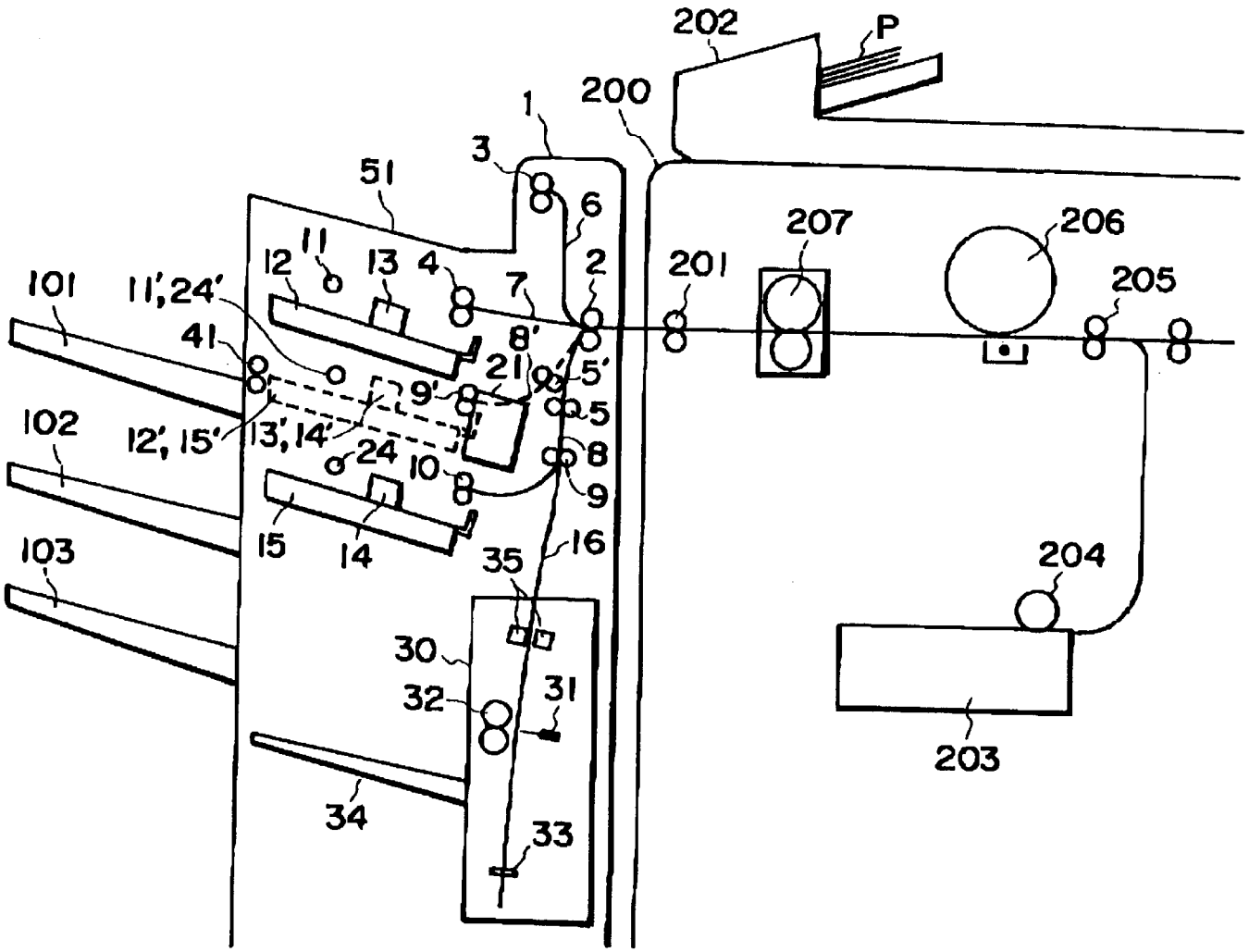
FIG. 1 is a sectional view of a finisher according to an embodiment of the present invention.

Figure shows an apparatus according to embodiment 1, wherein reference numeral 200 designates a main assembly of a copying apparatus, and 1, a finisher. The finisher comprises pairs 2, 3, 4, 5, 9 and 10 of sheet feeding rollers, substantially vertically movable intermediate trays 12 and 15, alignment guides 13 and 14 provided in the intermediated trays 12 and 15, and a stapler 21. It further comprises trays 101, 102 and 103 for respective modes (copy, facsimile, printer or the like), which are integrally movable substantially in the vertical direction to face to sheep discharging rollers 41 which will be described hereinafter. The finisher further comprises a saddle stitch 30, a stapler 35, a stopper substantially vertically movable in accordance with sizes of sheets, a pushing plate for pushing toward the roller 32 the sheets of which the leading edges are stopped by the stopper 33, and a tray for stacking the sheets folded and discharged by the roller 32.

The main assembly of the copying apparatus comprises a sheet cassette 203, a sheet feeding roller 204, a registration roller 205, a photosensitive drum 206, a fixing roller 207.

Figure 16:
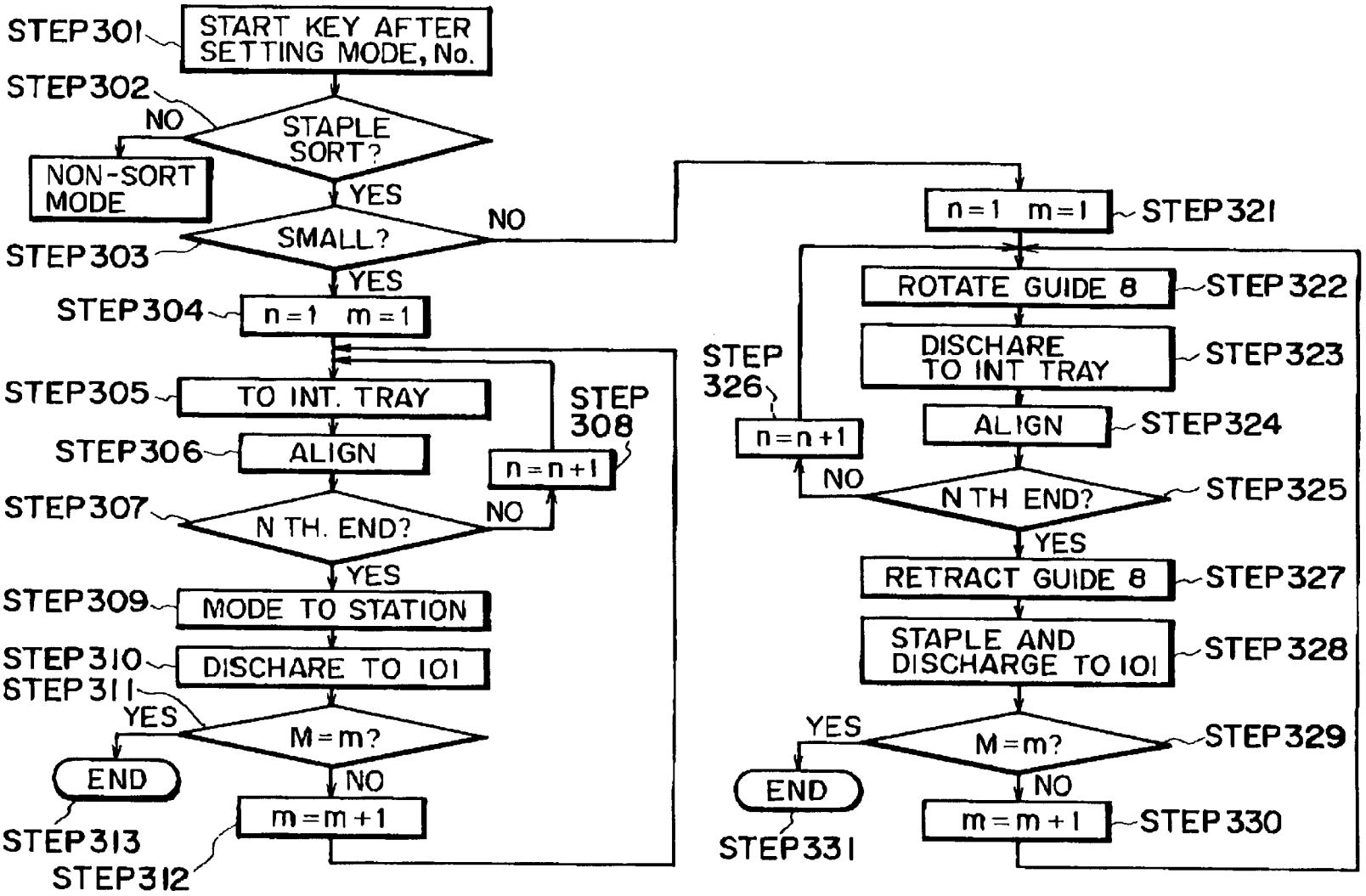
FIG. 16 is a flow chart of an operation of the apparatus of embodiment 1.
Figure 17:
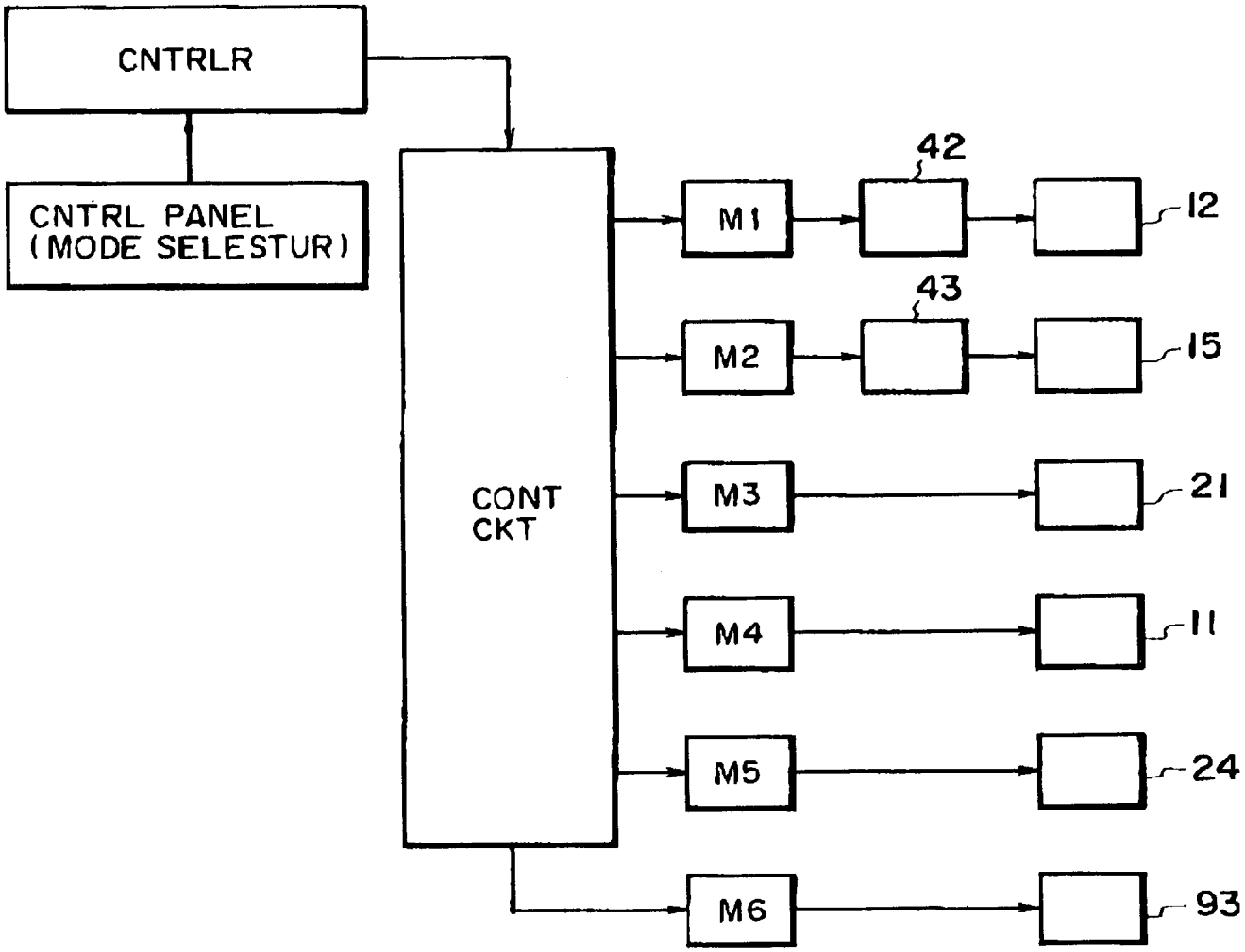
FIG. 17 is a block diagram.

Referring to FIG. 16, the operation will be described, FIG. 16 which is a flow chart. The operator places originals (documents) on an automatic document feeder of a circulation type (RDF) 202, and selects the mode (sorting, stapling and sorting, grouping, non-sorting modes or the like), and then depresses an unshown copy start key (step 301).

Figure 2:
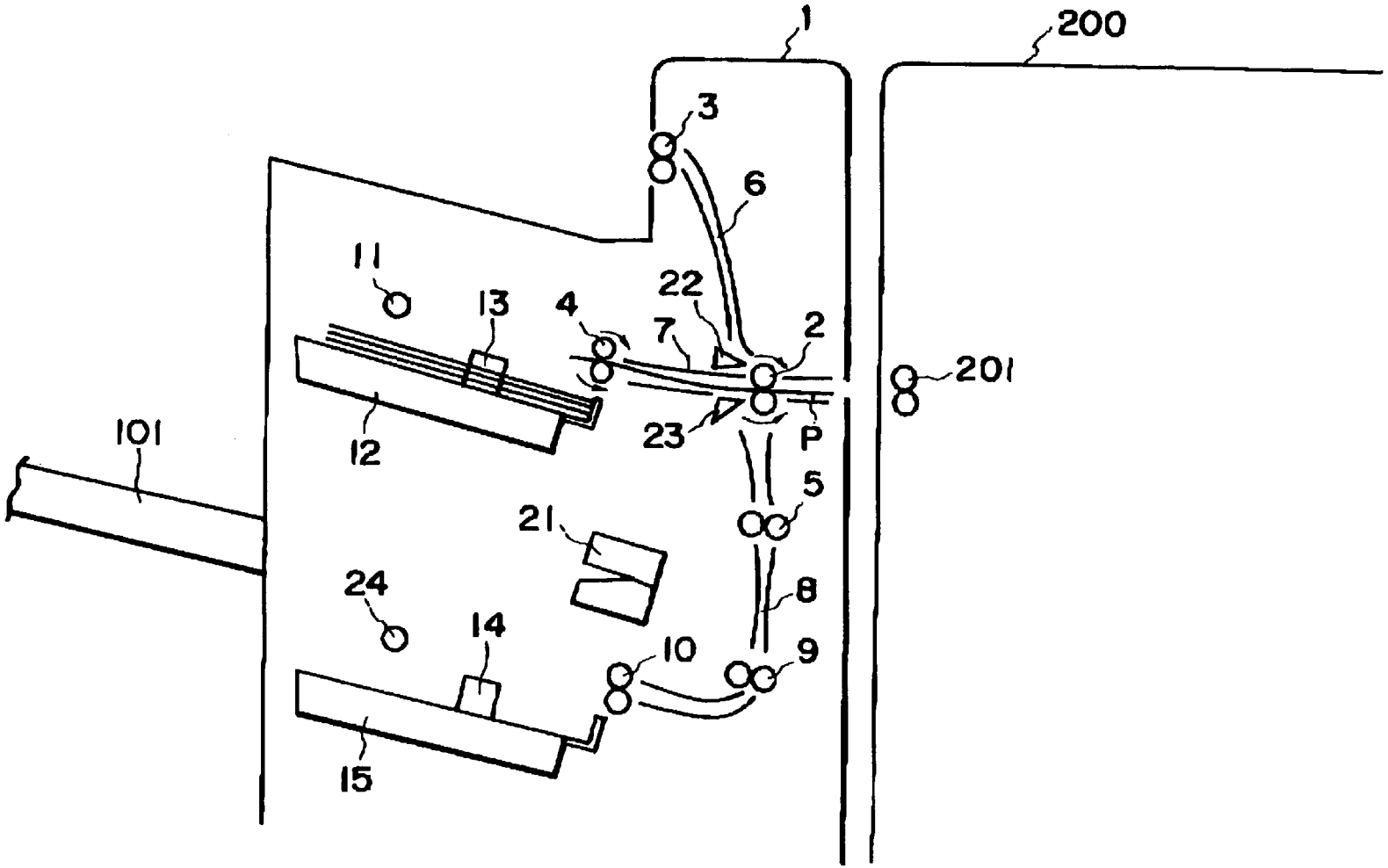
FIG. 2 is an illustration of operation of the apparatus of FIG. 1 (small size, stapling and sorting mode).
Figure 6:
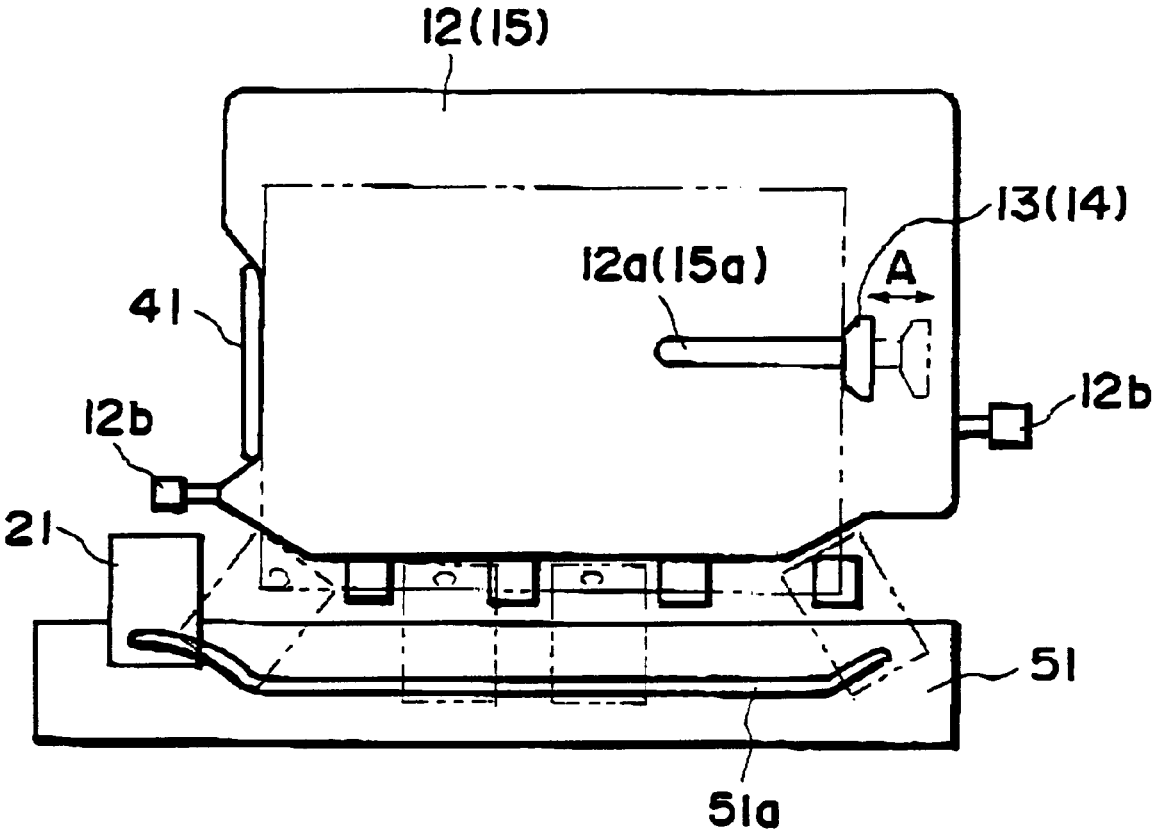
FIG. 6 is a top plan view of a stapler unit.

First the stapling mode will be described (step 302). The main assembly 200 reads the documents, fed by the document feeder, one by one, and forms images on transfer sheets by transferring the images thereonto. These sheets are fed to the finisher 1 by the sheet discharging roller 201. In the stapling and sorting mode selected, when the size of the transfer sheet is small (step 303), the finisher 1 discharges, to the tray 12 by the roller pairs 2 and 4, the sheet P discharged from the main assembly 200, as shown in FIG. 2 (step 305). The tray 12 itself has a jogging guide 13, as shown in FIG. 6. The jogging guide 13 is reciprocable in a direction A indicated by an arrow in a groove 12*a* formed in the tray 12 by an unshown motor. After the sheet is discharged on the tray 12, the jogging guide 13 urges the sheets to the alignment wall on the tray 12 in accordance with the sheet width, and retracts before the next sheet comes (step 306).

Figure 3:
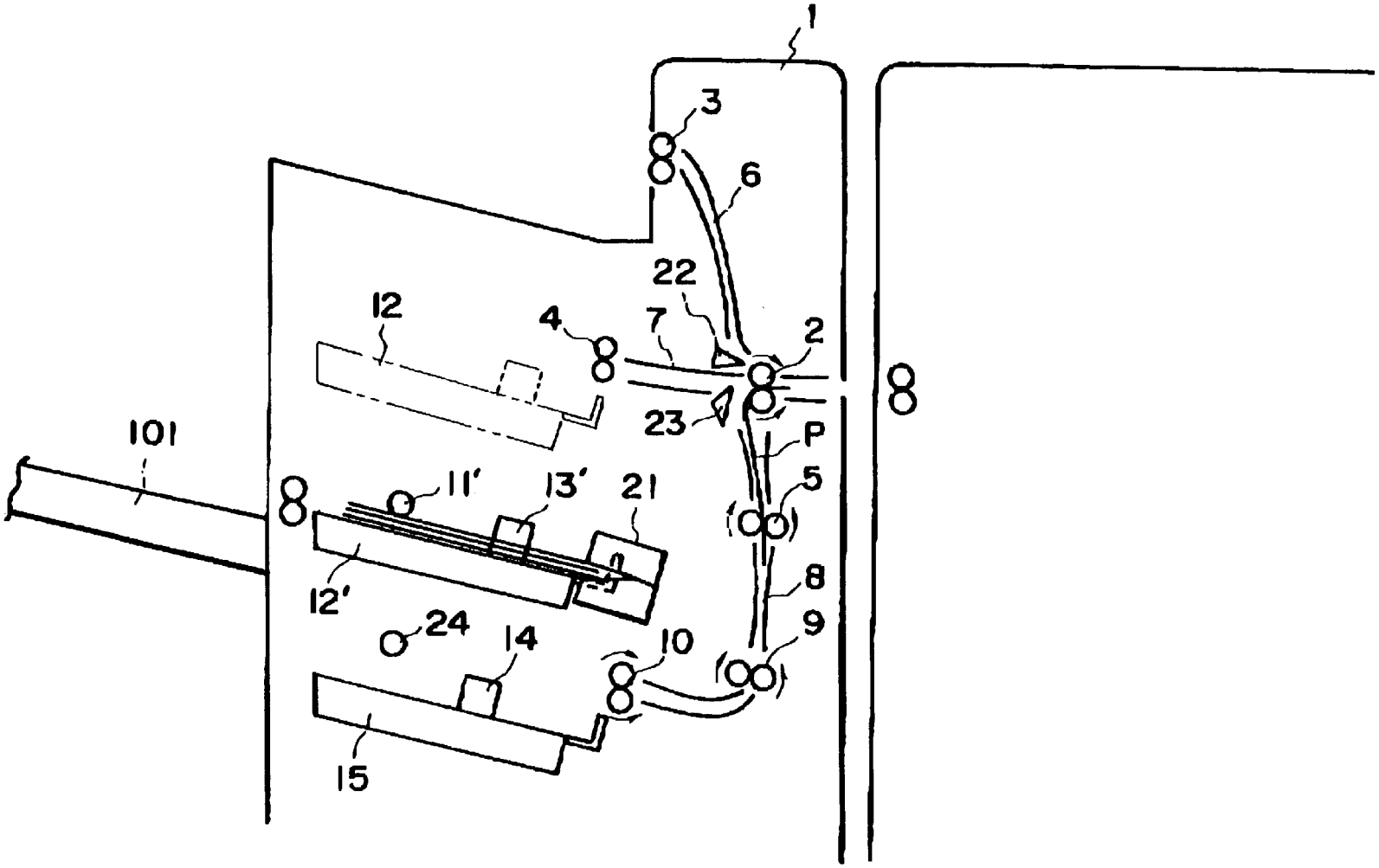
FIG. 3 is an illustration of operation (small size, stapling and sorting mode).
Figure 7:
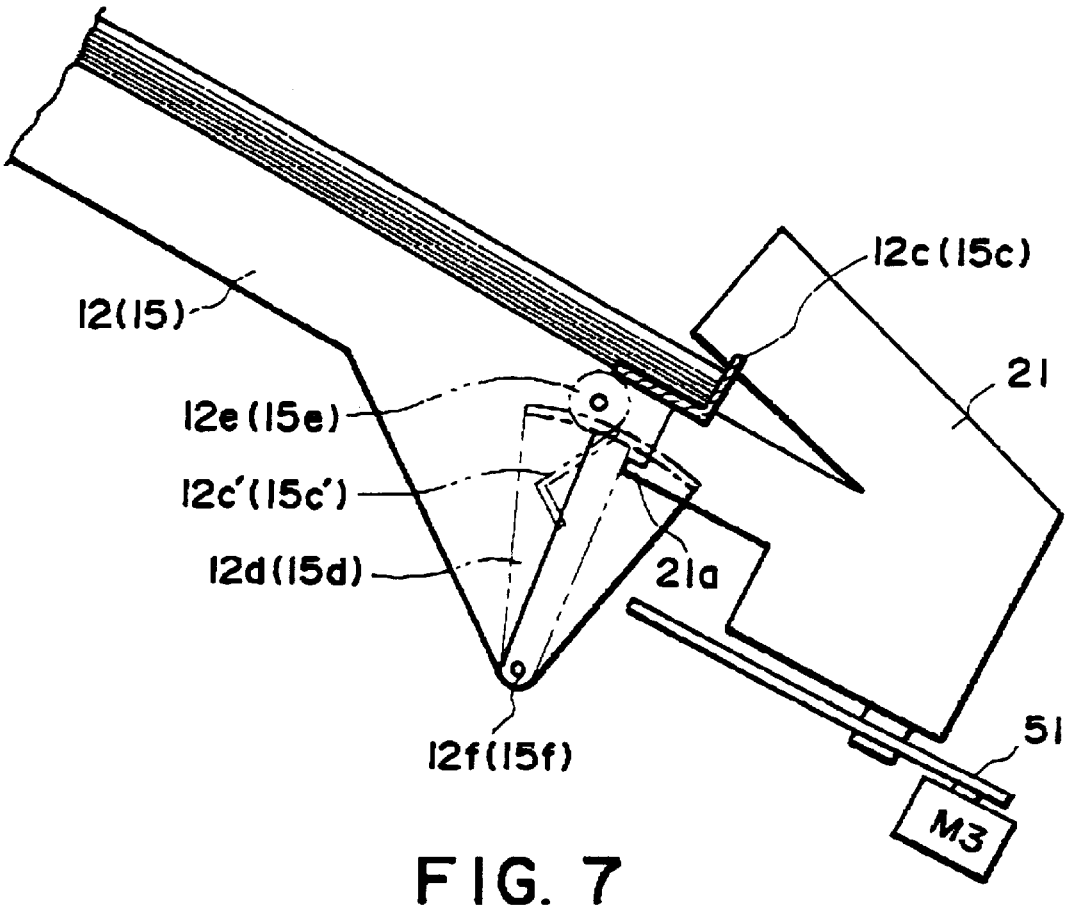
FIG. 7 is a sectional view of a stapler and an intermediate tray.
Figure 8:
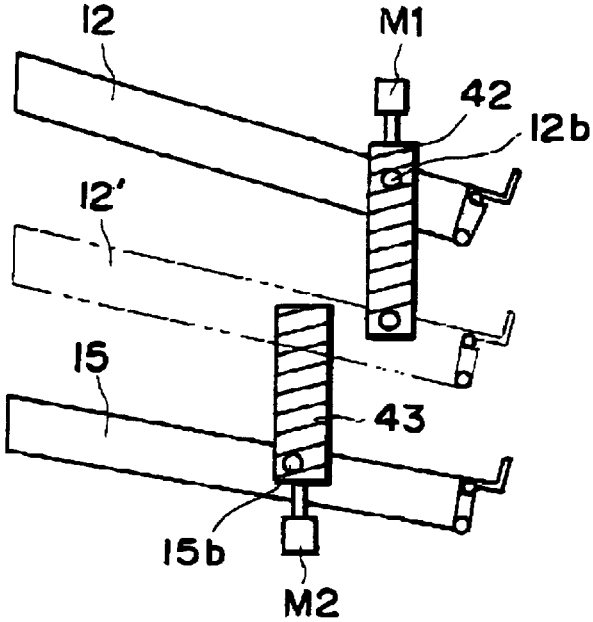
FIG. 8 is an illustration of bin shift.

When all of the transfer materials corresponding to all the documents fed by the document feeder 202 are stacked on the tray 12 (step 307), the jogging guide 13 urges the transfer materials to the alignment wall 41 as shown in FIG. 6, and the tray 12 lowers to a position (12') indicated by a solid line in FIG. 3, by rotation of a lead cam (tray moving means) 42 shown in FIG. 8 (step 309). A flapper 23 moved to a position shown in FIG. 3, and feed the next sheet to the tray 15. As shown in FIG. 6, the stapler 21 is normally at a retracted position (home position) indicated by a solid line, but upon the stapling operation, it is movable along a recess 51*a* on a stapling table 51. As shown in FIG. 7, a rear end stopper 12*c* of the tray 12 is provided integrally with a gear 12*e* meshing with a sector gear 12*d* on the tray 12. When the stapler 21 moves, a projection 21*a* of the stapler pushes the sector gear 12*d*, so that the stopper 12*c* adjacent the stapler 21 is moved to a chain line position (12*c*'). The stapler 21 moves to a position corresponding to the selected mode, and carries out the stapling operation, and then returns to the home position. The lowered feeding roller 11', as shown in FIG. 3, feeds the set of sheets on the tray 12 to discharge it onto a tray 101. Then, the tray 12 is raised by backward rotation of lead cam 42 to the initial position (step 310). As for the roller 41, the inter-axis distance is changeable in accordance with the thickness of the set of sheets.

The lead cam 42 is engaged with a trunnion (cam follower) 12*b* provided on a side surface of the tray. The feeding roller 11 takes a upper home position, and lowers upon the sheet set discharge, and is supported on a substantially vertically movable arm and is controlled by rotatable solenoid or the like. The rotation is transmitted from a motor through a belt.

Figure 4:
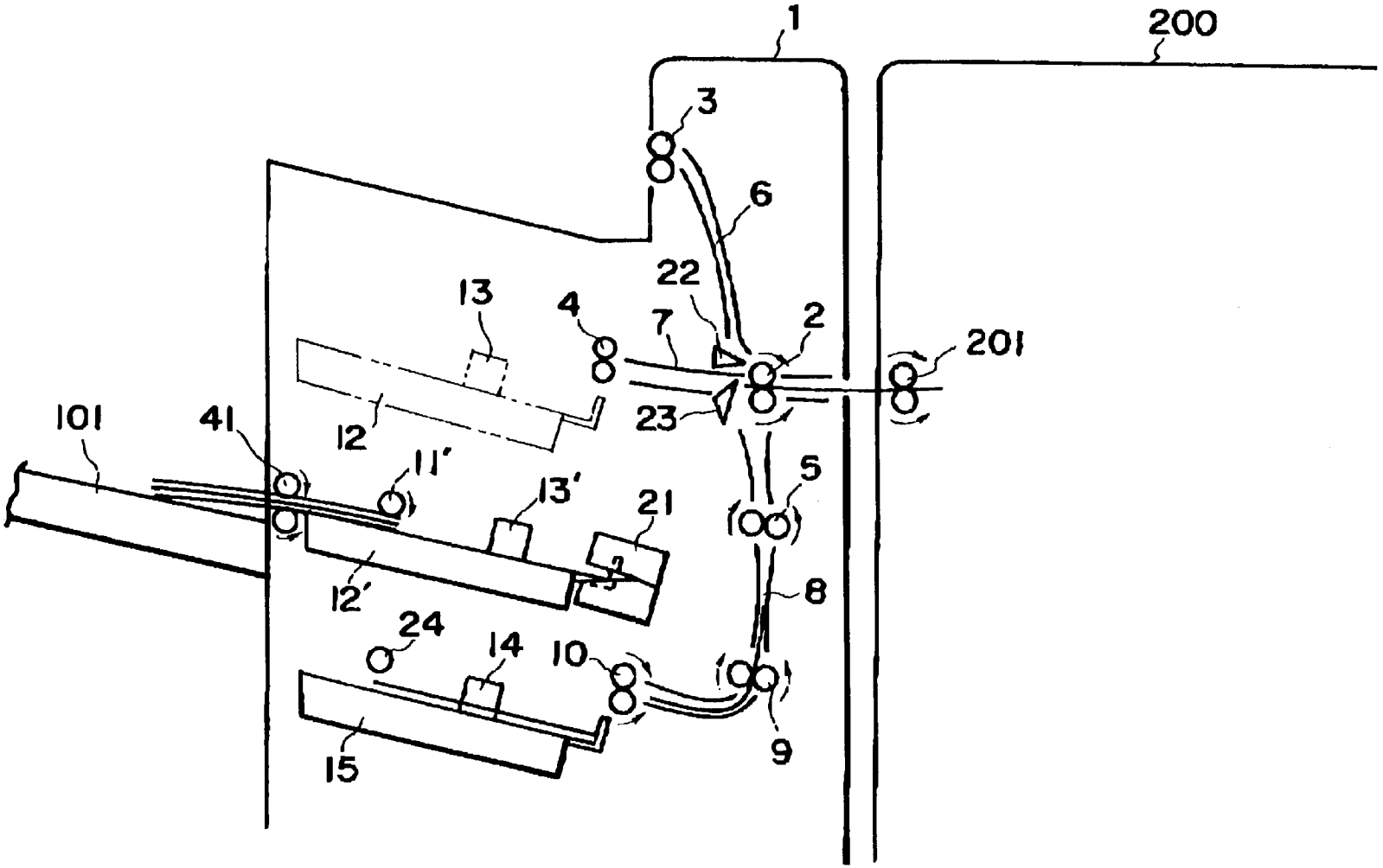
FIG. 4 is an illustration of operation (small size, stapling and sorting mode).
Figure 5:
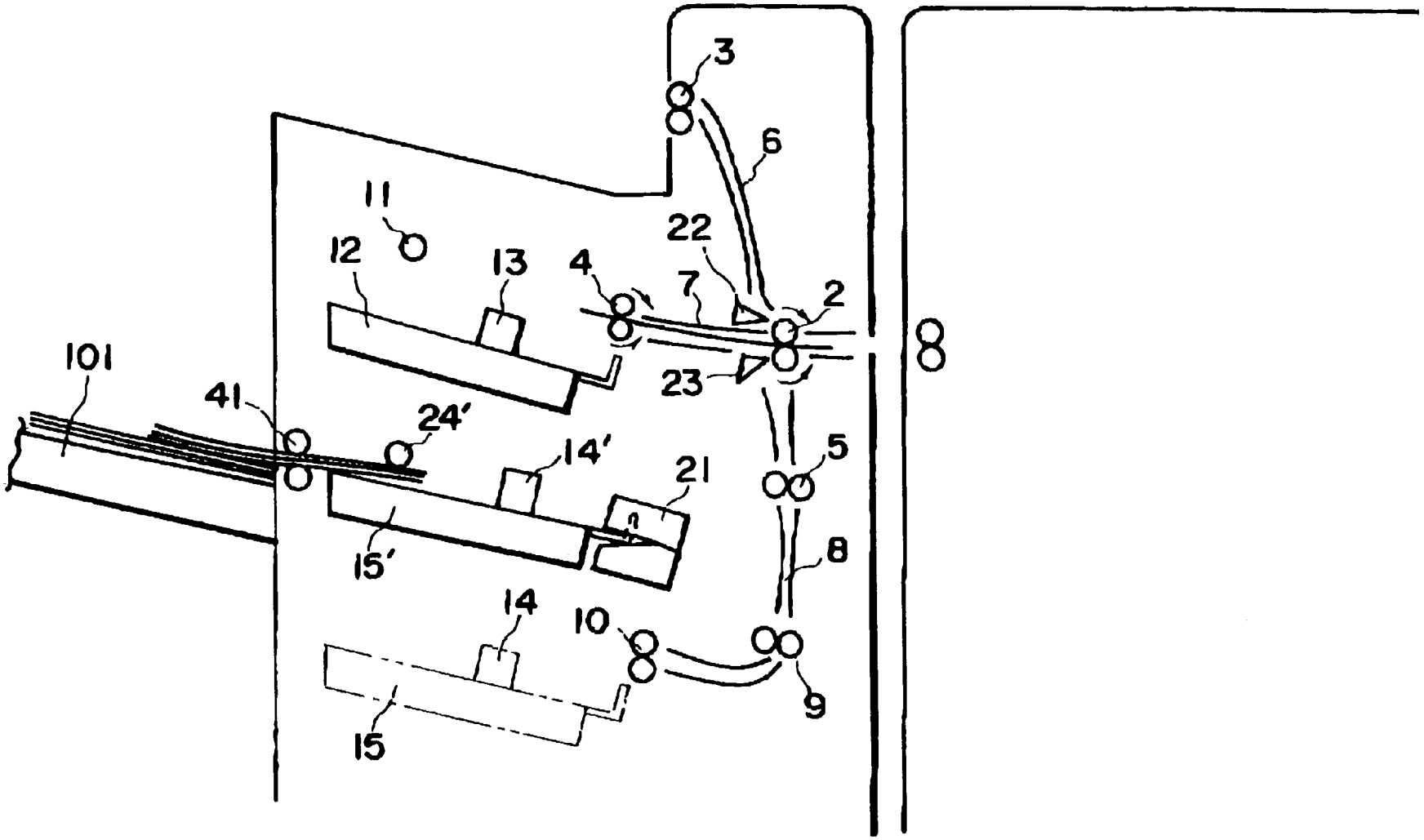
FIG. 5 is an illustration of operation (small size, stapling and sorting mode).

On the other hand, the sheets fed from the main assembly 200 are stacked on the tray 15, as shown in FIG. 4. They are stacked until the last sheet, similarly to the case of tray 12. The roller 24 having the same structure as the roller 11 is at the upper position. The tray 15 is raised to a position shown in FIG. 5 (15'), and the stapling and set discharging operations are carried out in the same manner as with the first set, during which the transfer materials discharged from the main assembly, are received by the tray 12. The above-described operations are repeated, and the preset numbers of sets of sheets are stacked on the tray 101 (step 313).

Figure 9:
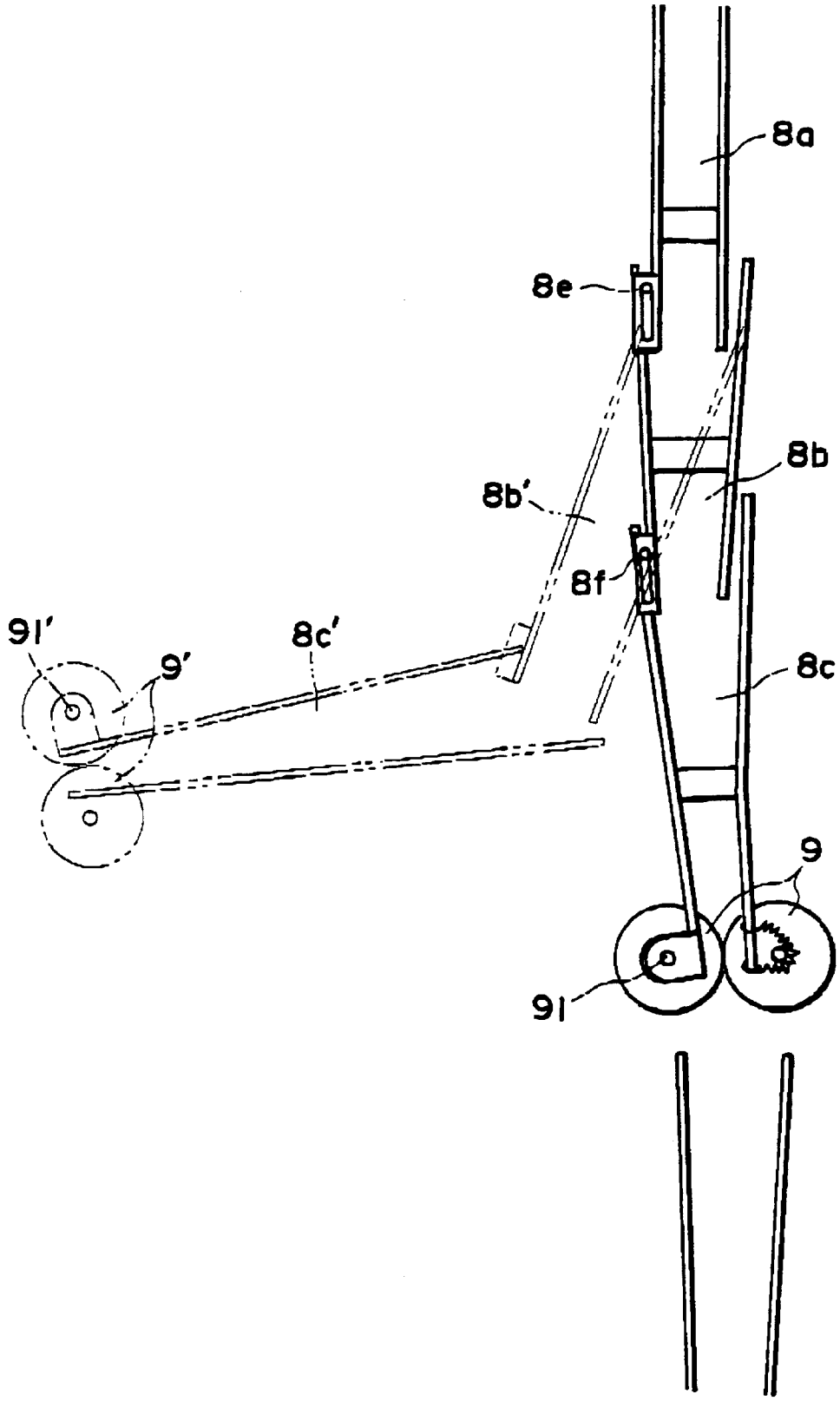
FIG. 9 is an illustration of path rotation.
Figure 10:
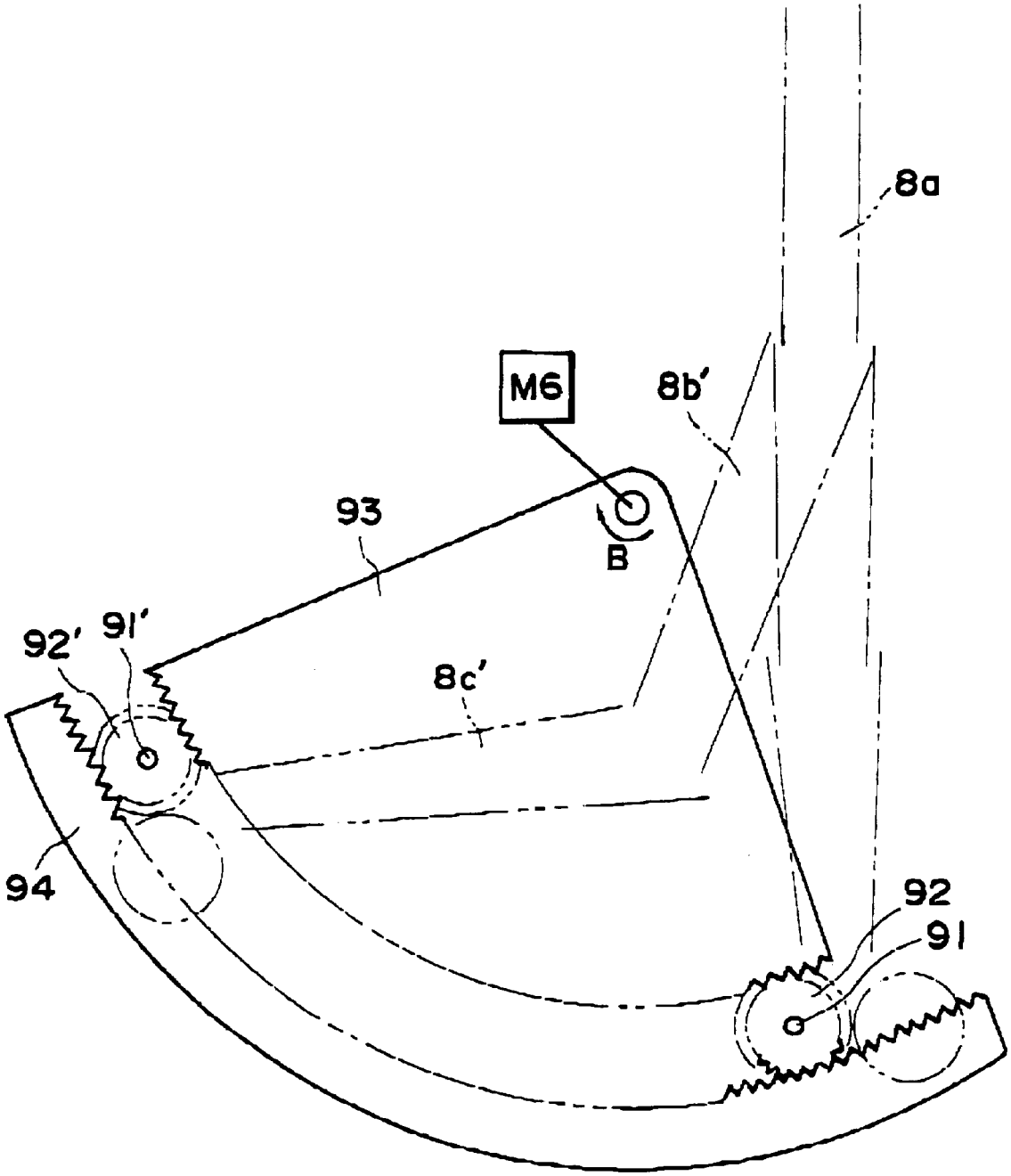
FIG. 10 is an illustration of a mechanism for the path rotation.

The description will be made as to when a large size, stapling and sorting mode is selected at step 303 in FIG. 16. As shown in FIG. 9, the sheet path 8 includes separate paths 8*a*, 8*b* and 8*c*, and the facing guides are fixed at a position out of the sheet width. The paths 8*a*, 8*b* and 8*c* are expansively combined by pins 8*e* and 8*f* and grooves. At the end of the guide 8*c*, a pair of rollers 9 is provided. As shown in FIG. 10, the shaft 91 of the roller 9 is meshed with a rack gear 94 and a sector gear 93 mounted on a side plate (not shown).

Figure 11:
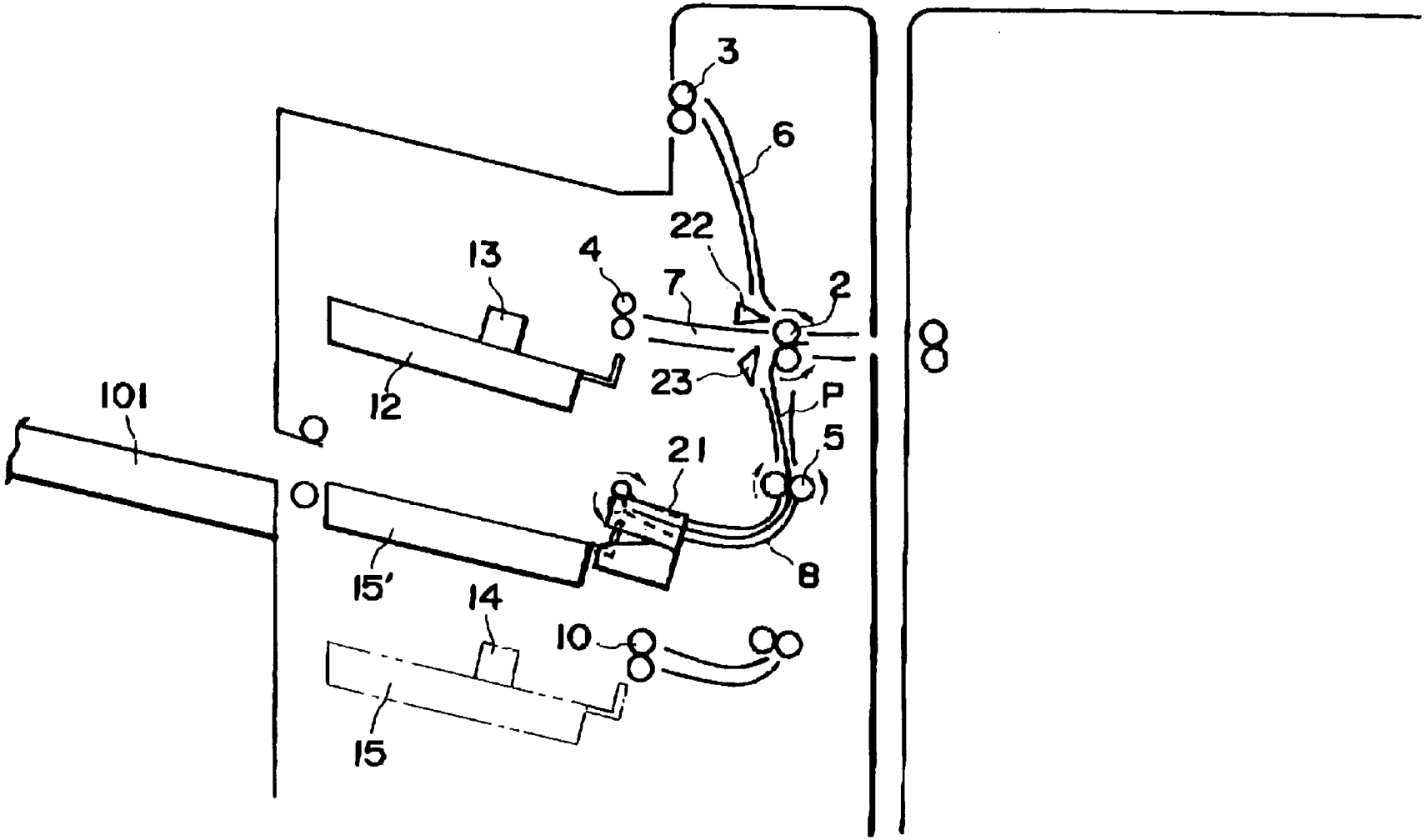
FIG. 11 is an illustration of operation (large size, stapling and sorting mode).
Figure 12:
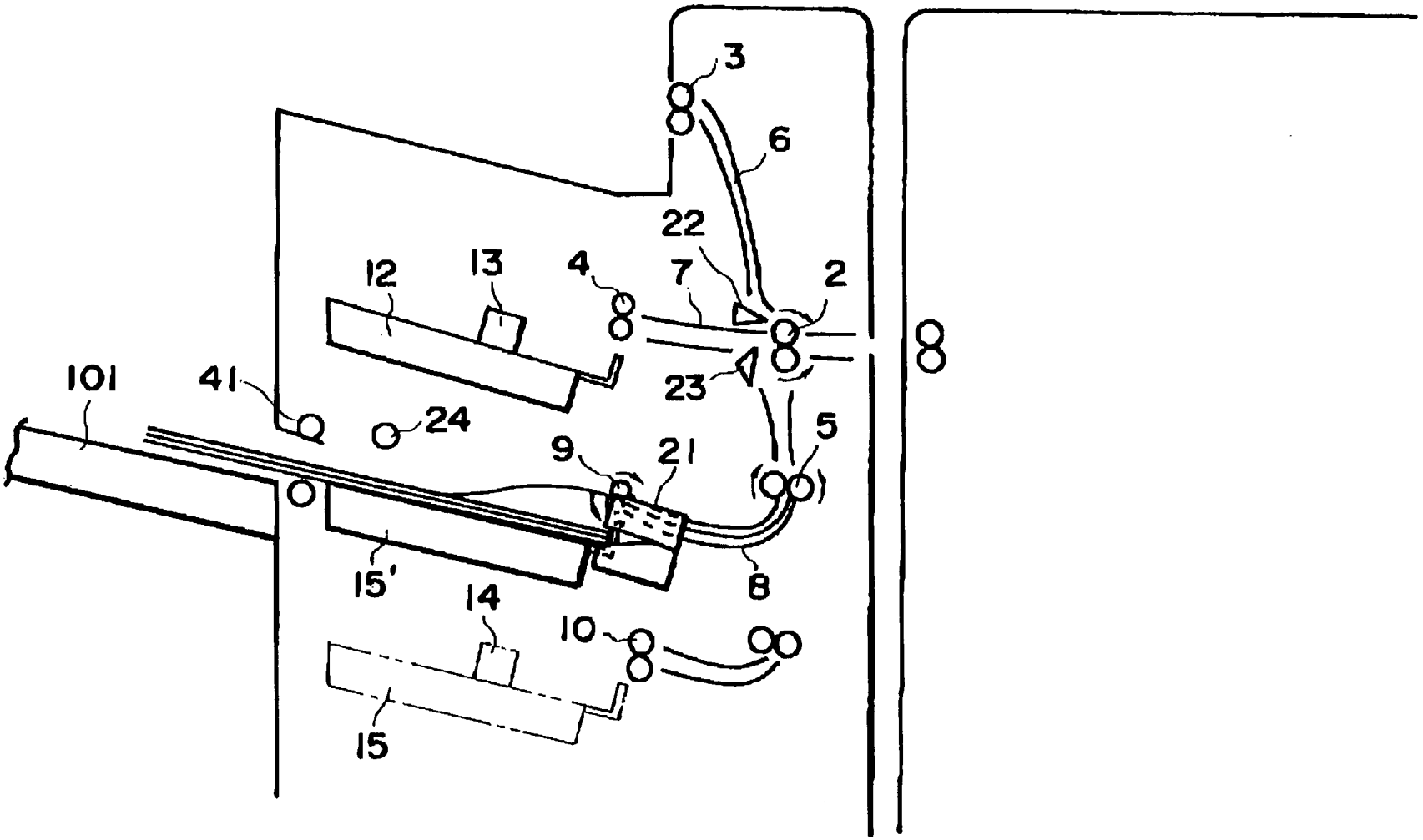
FIG. 12 is an illustration of operation (large size, stapling and sorting mode).
Figure 13:
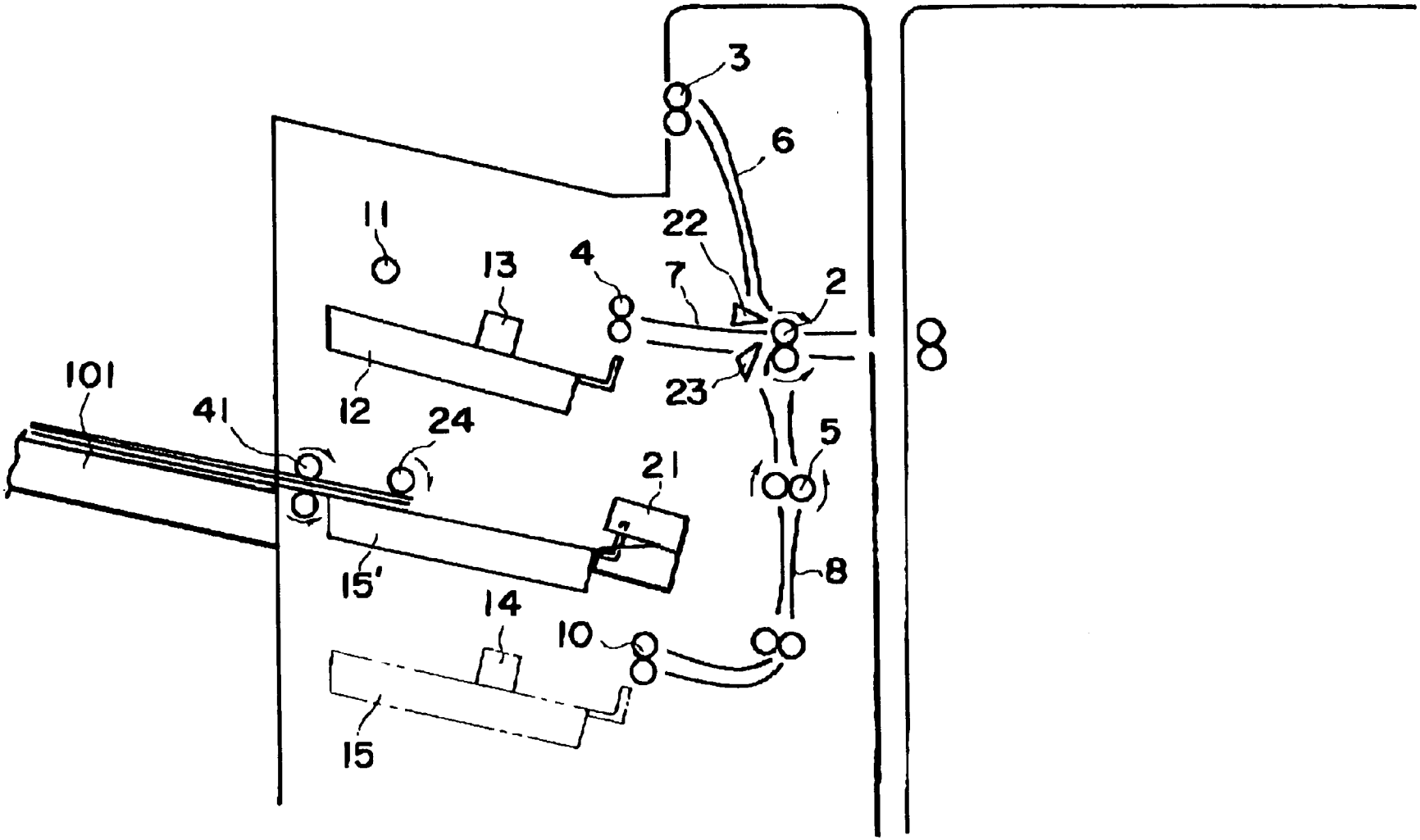
FIG. 13 is an illustration of operation (large size, stapling and sorting mode).

When the stapling and sorting mode and large size mode are selected, and then the copy start key is depressed, the sector gear 93 moves in a direction B in FIG. 10 by a motor M, so that the guides 8*b*, 8*c* moves to positions indicated by 8*b*' and 8*c*' (step 322). As shown in FIG. 11, the guide 8 moves to a position for permitting the sheets to be discharged to the tray 15 at the stapling position 15'. The stapler 21 is at the home position. The flapper 23 is at the position indicated in the Figure, and the sheets P are stacked on the tray 15 and tray 101, bridging therebetween, as shown in FIGS. 12 and 13. At this time, rollers 24 and 41 are at the upper position or spaced position to permit passage of sheets. The roller 41 is swingably supported by arm or the like, and is controlled by rotary solenoid or the like. The rotations of the rollers 24 and 41 are controlled by the motor through a belt.

Embodiment 2

Figure 14:
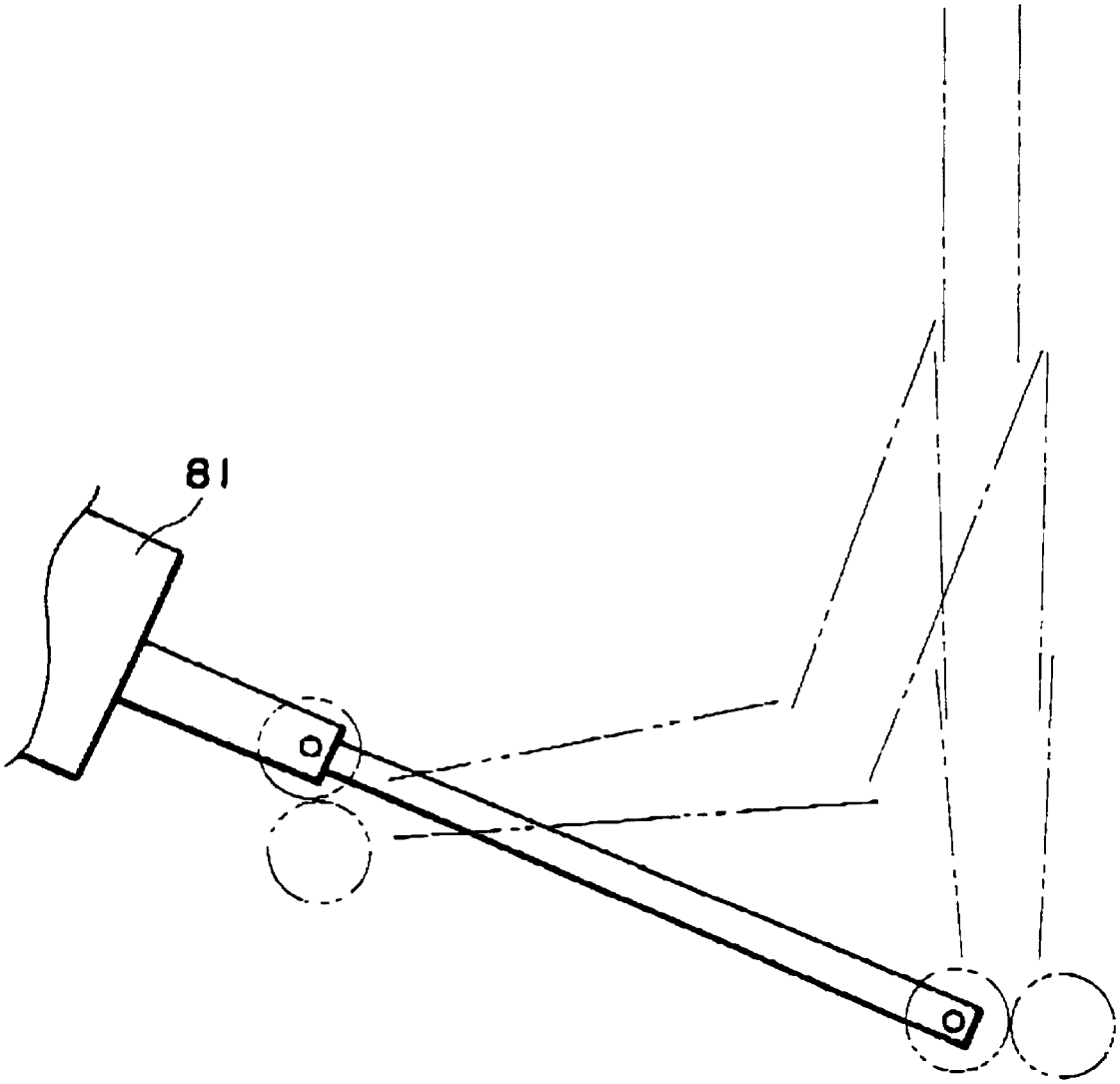
FIG. 14 shows an apparatus according to embodiment 2.

In embodiment 1, the sector gear 93, rack gear 94 rotates the guides 8*b* and 8*c*. In embodiment 2, the means for rotating the guides is a solenoid 81, as shown in FIG. 14.

Embodiment 3

In embodiment 1, the selected mode is a large size, stapling and sorting mode. However, non-sorting mode is operable.

Figure 15:
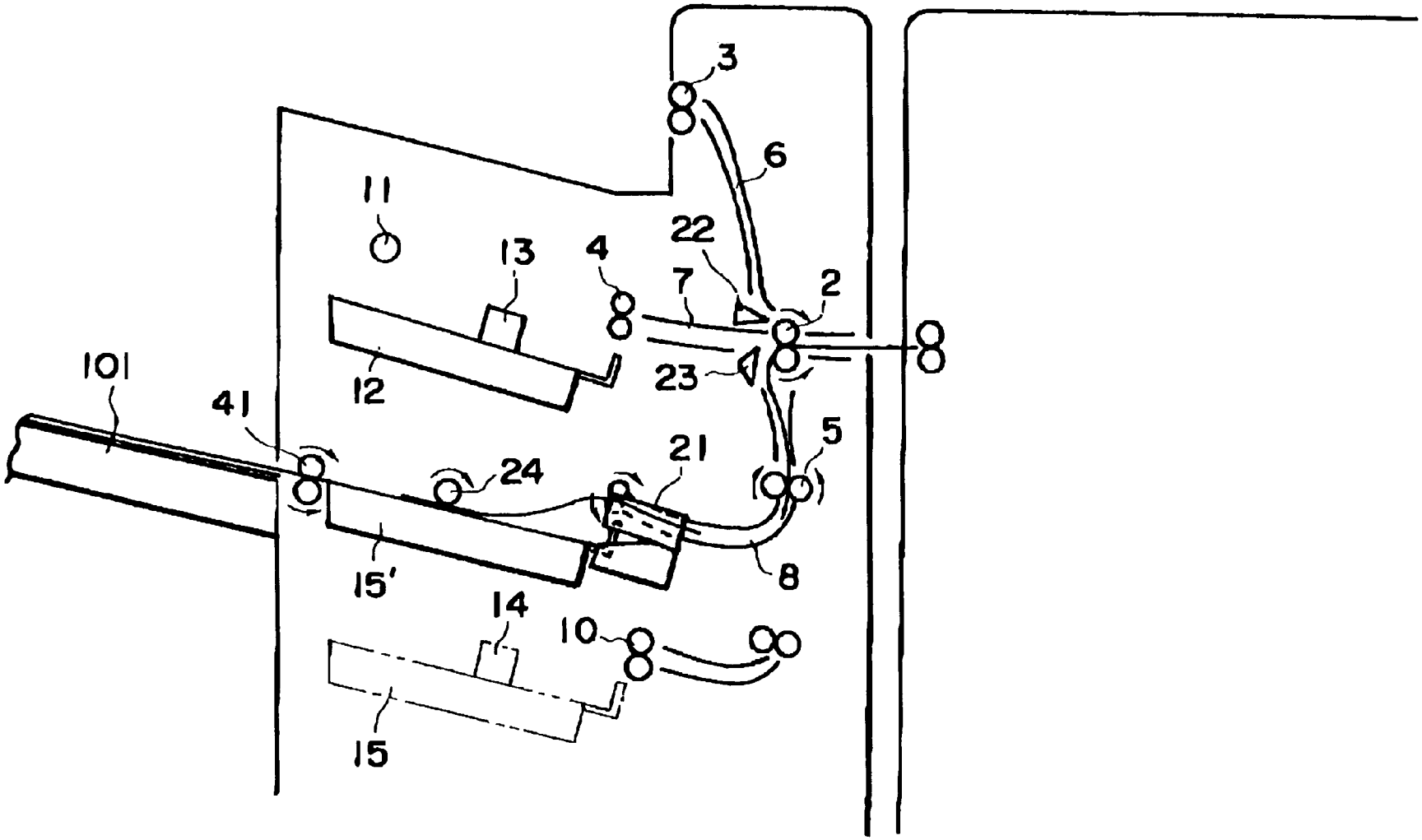
FIG. 15 shows an apparatus according to embodiment 3.

As shown in FIG. 15, the guide 8 is moved to a position for permitting the sheets to be discharged to the tray 15' located at the stapling position. The sheets are not accumulated, but are fed to the tray 101 by rollers 24 and 41, and then discharged and stacked. The rollers 24 and 41 are placed at low or contact position, beforehand.

While the invention has been described with reference to the structures disclosed herein, it is not confined to the details set forth and this application is intended to cover such modifications or changes as may come within the purposes of the improvements or the scope of the following claims.

What is claimed is:

1. A sheet processing apparatus, comprising:

a plurality of sheet discharging means for discharging sheets;

a plurality of intermediate trays for temporarily stacking the sheets discharged by said discharging means;

processing means for processing the sheets;

at least one accommodating tray for receiving and accommodating the sheets from the intermediate trays;

control means for stacking the sheets on one of said intermediate trays from one of said discharging means and moving the intermediate tray to permit the sheets to be processed by said processing means;

then stacking the sheets, during processing of the sheets on said one of the intermediate trays, on another one of said intermediate trays from another one of said discharging means;

then returning, after discharging the sheets from said one of the intermediate trays to said at least one accommodating tray after processing the sheets thereon, said one of the intermediate trays to said one of the discharging means;

then moving the another one of said intermediate tray to permit the sheets to be processed by said processing means; and discharging the processed sheets to said accommodating tray.

2. An apparatus according to claim 1, wherein said one of the discharging means is disposed above said processing means, and said another one of the discharging means is disposed below said processing means, wherein said one of the intermediate trays is substantially vertically movable between said one of the discharging means and said processing means, and said another intermediate tray is substantially vertically movable between said another discharging means and said processing means, and wherein said at least one accommodating tray is disposed at a position facing to said processing means and downstream of said intermediate tray.

3. An apparatus according to claim 2, wherein a plurality of such accommodating trays are provided, and are movable substantially vertically to permit each of them to face said processing means.

4. A sheet processing apparatus comprising:

a plurality of intermediate trays for temporarily stacking sheets discharged by a discharging means;

processing means for processing the sheets;

at least one accommodating tray for receiving and accommodating the sheets from the intermediate trays;

control means for feeding the sheets from one of said intermediate trays after the sheets thereon are processed by said process means;

means for moving another one of said intermediate trays between a home position for receiving the sheets from an image forming apparatus and a position for the processing by said processing means to permit the sheets to be stacked, while the sheets on said one of said intermediate trays are processed or fed to said accommodating tray.

5. An apparatus according to claim 4, further comprising means for aligning the sheets on the intermediate trays, said aligning means urging the sheets stacked on said intermediate tray.

6. An apparatus according to claim 5, wherein said intermediate trays are movable independently from each other.

7. A sheet processing apparatus comprising:

a plurality of intermediate trays for temporarily stacking sheets discharged by a discharging means;

processing means for processing the sheets;

at least one accommodating tray for receiving and accommodating the sheets from the intermediate trays;

control means for feeding the sheets from one of said intermediate trays after the sheets thereon are processed by said process means;

wherein when the sheets have a relatively small size, the intermediate tray receives the sheets at a position other than at the processing means, and feeds the sheets, after a predetermined number of sheets are received thereon, to said processing means, which processes the sheets, which are in turn discharged to said accommodating tray; wherein next sheets are received by another one of said intermediate trays;

wherein when the sheets have a relatively large size, said intermediate tray moves to said processing means to receive the sheets by said intermediate tray and said accommodating trays so that the sheets bridge therebetween, and after a predetermined number of sheets are received, the sheets are processed by said processing means, and are discharged to said accommodating tray.

8. An apparatus according to claim 7, wherein a sheet path for feeding the sheets to said intermediate tray moved to processing means is retractable to a position not interfering with said processing means.

9. An apparatus according to claim 8, wherein said path, when it is located at the retracted position, functions as a part of a path to said intermediate tray located at other than said processing means.

10. An apparatus according to claim 7, wherein when the sheets have the relatively large size, and when the sheets are not to be processed by said processing means, the sheets discharged to said intermediate tray are discharged to said accommodating tray, as they are.

11. An apparatus according to claim 7, wherein said one of the discharging means is disposed above said processing means, and said another one of the discharging means is disposed below said processing means, wherein said one of the intermediate trays is substantially vertically movable between said one of the discharging means and said processing means, and said another intermediate tray is substantially vertically movable between said another discharging means and said processing means, and wherein said accommodating tray is disposed at a position facing to said processing means and downstream of said intermediate tray.

12. An apparatus according to claim 3, wherein a plurality of such accommodating trays are provided, and are movable substantially vertically to permit each of them to face said processing means.

13. A sheet processing apparatus comprising:

a plurality of intermediate trays for temporarily stacking sheets discharged by a discharging means;

processing means for processing the sheets;

at least one accommodating tray for receiving and accommodating the sheets from the intermediate trays;

control means for feeding the sheets from one of said intermediate trays after the sheets thereon are processed by said process means;

wherein when the sheets have a relatively small size, the intermediate tray receives the sheets at a position other than at the processing means, and feeds the sheets, after a predetermined number of sheets are received thereon, to said processing means, which process the sheets, which are in turn discharged to said accommodating tray; wherein next sheets are received by another one of said intermediate trays;

wherein when the sheets have a relatively large size and are not to be processed by said processing means, said intermediate tray moves to said processing means to receive the sheets by said intermediate tray and said accommodating trays so that the sheets bridge therebetween, and the sheets are discharged to said accommodating tray without being processed by said processing means.

14. An apparatus according to claim 13, wherein a sheet path for feeding the sheets to said intermediate tray moved to said processing means is retractable from a position not interfering with said processing means.

15. An apparatus according to claim 14, wherein said path, when it is located at the retracted position, functions as a part of a path to said intermediate tray located at other than said processing means.

16. An image forming apparatus comprising image forming means and a sheet post processing apparatus as defined in claim 1.

17. An apparatus according to claim 7 or 13, wherein said small size corresponds to a size accommodatable by the intermediate tray, and said larger size is larger than said small size.

18. An apparatus according to claim 1, 4, 7 or 13, wherein the discharging of the processed sheets are effected using a roller for discharging a set of such sheets.

19. A sheet processing apparatus, comprising:

a plurality of sheet discharging means for discharging sheets;

a plurality of intermediate trays for temporarily stacking the sheets discharged by said discharging means;

processing means for processing the sheets;

at least one accommodating tray for receiving and accommodating the sheets from the intermediate trays;

control means for stacking the sheets on one of said intermediate trays from one of said discharging means and moving the intermediate tray to permit the sheets to be processed by said processing means;

then stacking the sheets, during processing of the sheets on said one of the intermediate trays, one another one of said intermediate trays from another one of said discharging means;

then returning, after processing the sheets thereon, said one of the intermediate trays to said one of the discharging means;

then moving the another one of said intermediate tray to permit the sheets to be processed by said processing means.

20. A sheet finishing apparatus, comprising:

a plurality of sheet discharging means for discharging sheets;

a plurality of intermediate trays for temporarily stacking the sheets discharged by said discharging means;

processing means for processing the sheets;

at least one accommodating tray for receiving and accommodating the sheets from the intermediate trays;

control means for stacking the sheets on one of said intermediate trays from one of said discharging means and moving the intermediate tray to permit the sheets to be processed by said processing means;

then stacking the sheets during processing of the sheets on said one of the intermediate trays, on the another one of said intermediate trays from another one of said discharging means;

then returning, after discharging the sheets from said one of the intermediate trays to the at least one accommodating tray after processing the sheets thereon, said one of the intermediate trays to said one of the discharging means;

then moving the another one of said intermediate tray to permit the sheets to be processed by said processing means; and discharging the processed sheets to said accommodating tray.

21. A sheet finishing apparatus, comprising:

a plurality of sheet discharging means for discharging sheets;

a plurality of intermediate trays for temporarily stacking the sheets discharged by said discharging means;

processing means for processing the sheets;

at least one accommodating tray for receiving and accommodating the sheets from the intermediate trays;

control means for stacking the sheets on one of said intermediate trays from one of said discharging means and moving the intermediate tray to permit the sheets to be processed by said processing means;

then stacking the sheets, during processing of the sheets on said one of the intermediate trays, on another one of said intermediate trays from another one of said discharging means;

then returning, after processing the sheets thereon, said one of the intermediate trays to said one of the discharging means;

then moving the another one of said intermediate tray to permit the sheets to be processed by said processing means.

* * * * *

UNITED STATES PATENT AND TRADEMARK OFFICE

CERTIFICATE OF CORRECTION

PATENT NO. : 5,992,838
DATED : November 30, 1999
INVENTOR(S) : Naho Saitoh

It is certified that error appears in the above-identified patent and that said Letters Patent is hereby corrected as shown below:

Title page,
Item [57], ABSTRACT,
Line 14, “tray:” should read -- tray --.
Line 18, “try” should read -- tray --.

Column 1,
Line 8, “a trays.” should read -- a tray. --.

Column 4,
Line 25, “a” should read -- an --.

Column 5,
Line 46, “tray” should read -- trays --.
Line 60, “at” should be deleted.
Line 61, “least one accommodating” should be deleted.
Line 65, “accommodating” should be deleted, and “are” (both occurrences) should read -- is --.

Column 6,
Line 3, “a” should read -- said --.
Line 5, “at least one accommodating” should read -- a --.
Line 6, “sheets” should read -- sheet --.
Line 11, “another one of” should be deleted.
Line 13, “an” should read -- the --.
Line 17, “tray.” should read -- tray, on another intermediate tray. --.
Line 29, “at least one accommodating” should read -- a --.
Line 30, “sheets” should read -- sheet --.

Column 7,
Line 16, “at least one accommodating” should read -- a --.
Line 17, “sheets” should read -- sheet --.

UNITED STATES PATENT AND TRADEMARK OFFICE

CERTIFICATE OF CORRECTION

PATENT NO. : 5,992,838
DATED : November 30, 1999
INVENTOR(S) : Naho Saitoh

It is certified that error appears in the above-identified patent and that said Letters Patent is hereby corrected as shown below:

Column 8,
Line 4, “one another” should be deleted.
Line 62, “tray” should read -- trays --.

Signed and Sealed this

Eighteenth Day of June, 2002

*Attest:*

*Attesting Officer*

JAMES E. ROGAN
*Director of the United States Patent and Trademark Office*